United States Patent [19]

Caroti

[11] Patent Number: 4,956,958

[45] Date of Patent: Sep. 18, 1990

[54] AUTOFITTING BUILDING BLOCKS AND BRICKS

[76] Inventor: Gino P. N. Caroti, 56 Mayflower Dr., Wilton, Conn. 06897

[21] Appl. No.: 311,088

[22] Filed: Feb. 15, 1989

[51] Int. Cl.[5] ..... E04B 5/04

[52] U.S. Cl. ..... 52/605; 52/606

[58] Field of Search ..... 52/606, 605, 233, 593; 405/284, 286

[56] References Cited

U.S. PATENT DOCUMENTS

| | | | |
|---|---|---|---|
| 1,686,270 | 10/1928 | Dwyer | 52/566 |
| 3,534,518 | 10/1970 | Zagray | 52/258 |
| 4,035,975 | 7/1977 | Gergely | 52/284 |
| 4,473,985 | 10/1984 | Hunt | 52/593 |
| 4,524,551 | 6/1985 | Scheiwiller | 52/605 X |
| 4,787,185 | 11/1988 | Gascho | 52/605 X |

*Primary Examiner*—Carl D. Friedman

*Attorney, Agent, or Firm*—Wegner & Bretschneider

[57] ABSTRACT

An autofitting building block has two opposing side surfaces, two opposing end surfaces, a top surface and a bottom surface. The top surface has a plurality of dihedral projections which mate with a plurality of dihedral recessions on the bottom surface. The bottom surface has at least one more recession than does the top surface so that a channel is formed between two stacked bricks. Grooves are preferably placed in the end walls which form vertical channels which communicate with the hozizontal passages. A wall made of such bricks is also disclosed. The blocks can be either solid or hollow, and special blocks can be used for the corners and for the ends of the wall.

17 Claims, 4 Drawing Sheets

FIG. 7
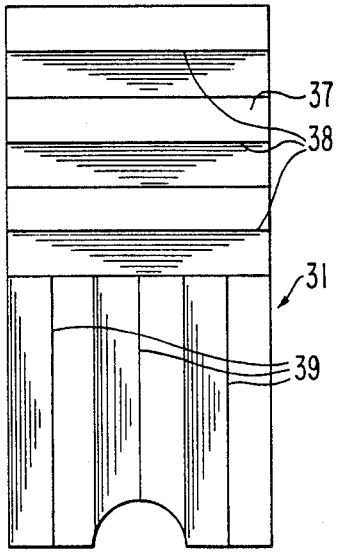
FIG. 6
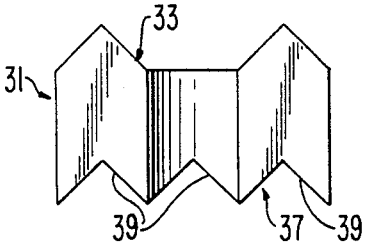
FIG. 8
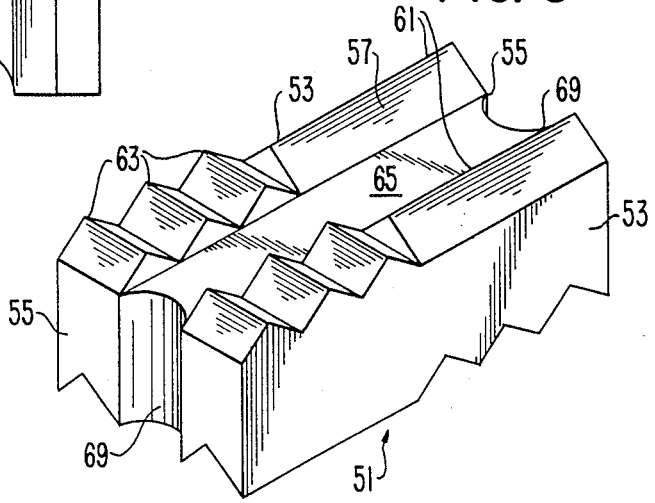
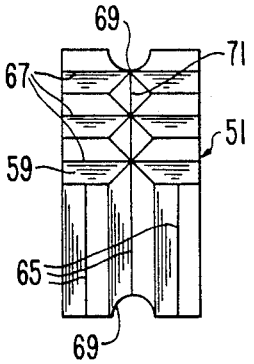
FIG. 9

AUTOFITTING BUILDING BLOCKS AND BRICKS

BACKGROUND OF THE INVENTION

This invention relates to interlocking building blocks or bricks which can be used to construct a wall without the need for mortar between the bricks.

Most brick or cement walls are constructed with a layer of mortar located between adjacent blocks and between adjacent layers of blocks. The mortar layer serves three primary purposes: one, it provides a mortar bed of various thickness in order to vertically align the bricks; two, it seals the interstices; and three, it strengthens the connection between the blocks.

However, systems are known which employ interlocking "mortarless" blocks which can be placed directly adjacent each other and directly on top of each other. Since no mortar is placed between the bricks, the blocks must be designed to interlock so as to maximize the stability of the wall as a whole. Furthermore, the interconnection between the blocks must be such that it ensures vertical alignment of the blocks. In such systems, mortar or grout is normally poured between the blocks after the wall is constructed.

Examples of known mortarless brick systems are shown in U.S. Pat. No. 3,534,518 to Zagray and U.S. Pat. No. 1,686,270 to Dwyer. However, these brick systems suffer from various drawbacks. One, they are generally complex in design, and thus are both difficult and expensive to manufacture and difficult to assemble properly. Second, they do not necessarily interconnect in a stable manner which minimizes possible misalignment in the direction transverse to the wall. Third, they often require several different types of blocks to construct a wall, and thus are difficult to store. Primarily due to the complexity and inefficiency of the prior systems, they have not had great commercial success.

SUMMARY OF THE INVENTION

It is an object of the invention to provide an interlocking building block which is simple in design, and is easy to manufacture, to understand, and to use for construction of a wall.

It is a further object to provide such a building block which maximizes the stability of the interconnection between vertically adjacent blocks.

It is also an object to provide a building block which, when used to form a wall, can guide the flow of grout or mortar poured into the wall so as to seal the interstices and increase the stability of the wall.

These and other objects are provided according to one aspect of the invention by a building block having two vertical end surfaces and two vertical side surfaces, a top surface having a plurality of dihedral projections extending along the longitudinal length of the block and a bottom surface which has a plurality of dihedral recessions also running along the longitudinal length of the block. Because of the dihedral projections and recessions, the bricks are autofitting to the extent that when a wall is constructed, the weight of the wall itself helps to press the projections and recessions into engagement with each other, thus increasing the stability and firmness of the wall.

The bottom surface of the brick has at least one more dihedral recession than the upper surface has dihedral projections. Vertical grooves, preferably semicircular in shape, can be provided in the vertical end surfaces of the brick in communication with this extra recession.

Therefore, when a wall of such bricks is constructed, adjacent grooves form a vertical channel through which grout can be poured.

The invention also includes a plurality of such blocks connected together to form a wall. In the first embodiment of the invention, at least one corner block is provided which has an upper surface having the same projection pattern as does the main block. However, the dihedral recessions on the lower surface of the block extend over only half the length of the block in the longitudinal direction. For a corner block used at a 90° corner, the other half of the lower surface of the block has the same kind of dihedral recessions extending in a direction perpendicular to those on the first half of the block. At a corner having an angle of anything other than 90°, a corner block is used having, along the other half of the lower surface of the block, a flat, recessed surface.

In the second embodiment of the invention, the upper and lower surfaces each have two patterns of dihedral projections and recessions extending longitudinally for half the length of the block and perpendicular for the other half. In this case, a corner block is not required; the same block can be used as both a stretcher block and a corner block.

The invention can be applied to blocks made of brick, cement (cinder block) or any other suitable material. Furthermore, the blocks can be completely solid, or they can have one or more holes which lighten the blocks and provide ventilation through the wall, or the can be of the completely hollow type.

BRIEF DESCRIPTION OF THE DRAWINGS

The preferred embodiments of the invention will be described further with references to the drawings, in which:

FIG. 6 is an end view of a corner block used to construct a wall according to the first embodiment;

FIG. 7 is a bottom view of the corner block of FIG. 6;

FIG. 8 is a perspective view of a building block according to a second embodiment of the invention;

FIG. 9 is a bottom view of the building block of FIG. 8;

DESCRIPTION OF THE PREFERRED EMBODIMENTS

Figure 1:
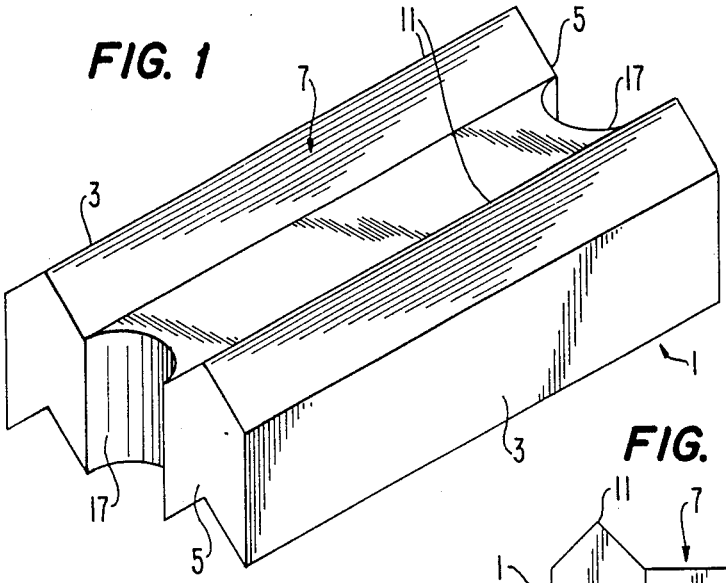
FIG. 1 is a perspective view of a building block according to a first embodiment of the invention.
Figure 2:
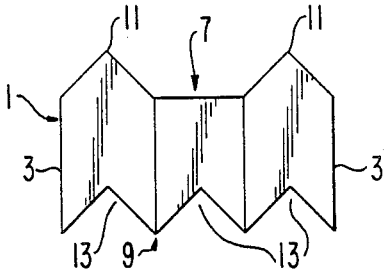
FIG. 2 is an end view of the building block of FIG. 1.

FIGS. 1 and 2 show the autofitting block according to the first embodiment of the invention The block 1 has side surfaces 3, end surfaces 5, a top surface 7 and a bottom surface 9. The top surface has two dihedral projections 11, each having a width at its base equal to one third the total width of the block. The projections 11 extend along the entire length of the top surface in the longitudinal direction, and are immediately adjacent the side surfaces 3. The portion of the top surface 7 between the projections is maintained planar.

Figure 3:
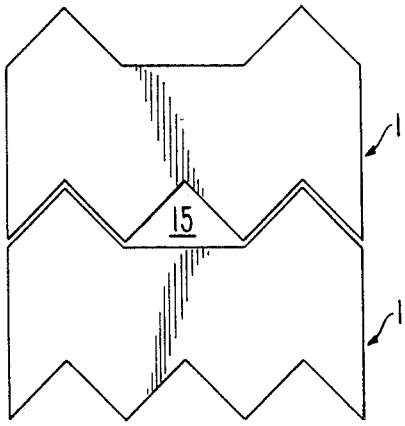
FIG. 3 is a cross-section showing two building blocks according to the first embodiment of the present invention placed on top of each other.

The bottom surface 9 in FIG. 1 has three dihedral recessions 13. The outer two dihedral recessions are of the same size and shape as the dihedral projections 11, and are located such that, as seen in FIG. 3, when two blocks are placed on top of each other, the two projections engage the outer two recessions so that the side surfaces 3 of the two blocks are essentially coplanar. Also as can be seen in FIG. 3, when two blocks are placed in vertical engagement, a horizontal channel 15 is formed between the middle recession of the upper block and the top surface of the lower block.

Figure 5:
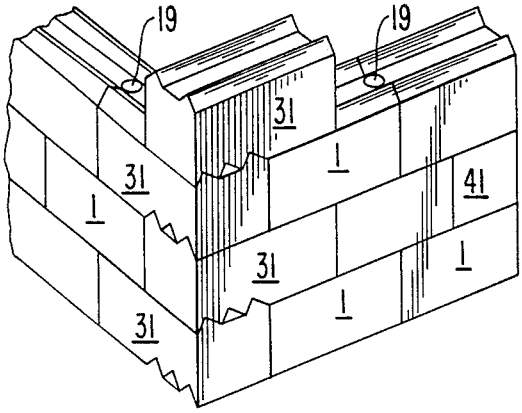
FIG. 5 is a perspective view showing a plurality of the building blocks of FIG. 1 placed together to form a wall.

The block further has two semicircular grooves 17 which extend vertically along the end surfaces 5. These grooves are located such that, as seen in FIG. 5, when two blocks are placed horizontally adjacent each other, a vertical channel 19 is formed between the blocks. The vertical channel 19 communicates with the horizontal channel 15. Therefore, when grout or mortar is poured into the vertical channel 19 after formation of a wall, the grout or mortar flows into the horizontal channels 15, thus sealing the interstices, as well as increasing the strength of the wall.

Figure 4:
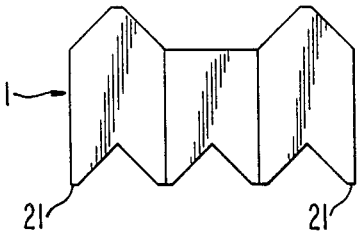
FIG. 4 is an end view of a modification of the building block of FIG. 1.

The dihedral projections and recessions shows in FIG. 1 form a 90° dihedral angle. Although it is possible to vary this angle, 90° is preferred because of its universality. Also, the 90° angle is adequate to prevent transverse movement between the bricks. Furthermore, it may be desirable avoid sharp corners and to flatten the outer edges 21 of the bottom surface (as seen in FIG. 4). These flattened edges avoid chipping of the blocks during transport and construction, and at the same time, improve the aesthetic appearance of the wall built with a plurality of the blocks 1.

Figure 13:
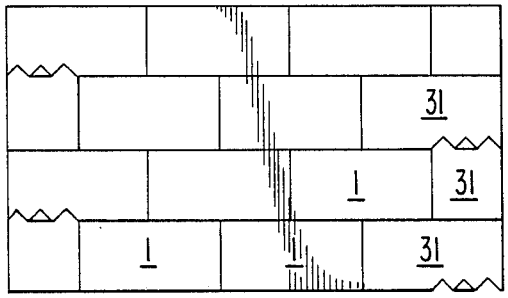
FIG. 13 is a front view showing a plurality of the building blocks of FIG. 1 placed together to form a wall.

If a plurality of the blocks are used to construct a wall (as seen in FIGS. 5 and 13), it is necessary to employ a different type of block for the corners. If a 90° corner exists, then a corner block 31 as shown in FIGS. 6 and 7 is used. The top surface 33 of the corner block 31 has two dihedral projections 35 like those of the block 1. The bottom surface 37 of the corner block 31 has three dihedral recessions 39 which extend in the longitudinal direction of the block, but only from one end surface to the midpoint. The other half of the bottom surface has three dihedral recessions 38 extending in the transverse direction of the corner block. If an angle other than 90° exists, the other half of the bottom is made flat.

The blocks according to the preferred embodiments are twice as long as they are wide. When a wall such as the one shown in FIG. 5 is constructed, it is necessary to use half blocks 41, which are half as long as the main block 1, at the end of the wall.

The second preferred embodiment is shown in FIGS. 8 and 9. In this embodiment, a block 51 again has side surfaces 53, end surfaces 55, a top surface 57 and a bottom surface 59. One half of the top surface has two dihedral projections 61 extending in the longitudinal direction, similar to those shown in FIG. 1. The other half of the top surface has three dihedral projections 63 extending in the transverse direction of the block. A planar surface 65 is formed between the projections 61 and extends through the projections 63.

One half of the bottom surface 59 has three dihedral recessions 65 extending in the longitudinal direction, similar to those shown in FIG. 1. The other half the bottom surface has three dihedral recessions 67 extending in the transverse direction of the block. Thus, when two blocks are placed on top of each other, the projections 61 mate with the recessions 65, and the projections 63 mate with the recessions 67.

Like the first embodiment, semicircular grooves 69 extend vertically in the end surfaces 55. Furthermore, additional cut-out portions 71 (FIG. 9) are formed between the recessions 65 in the bottom surface. Therefore, similar to what is shown in FIG. 3, when two blocks are placed on top of each other, a horizontal channel is formed between the blocks. Furthermore, the grooves 69 of two blocks placed end-to-end form a vertical channel 75 which communicates with the horizontal channel.

The primary advantage of the second embodiment over the first embodiment is that when a wall of such blocks is formed, a special corner block is not necessary. Like with the first embodiment, the blocks are twice as long as they are wide, and when the wall is ended, half-blocks are necessary. The outer sharp edges of the block in the second embodiment can be rounded similar to what is shown in FIG. 4 in order to avoid chipping of the block and improve the aesthetic appearance of the wall.

Figure 10:
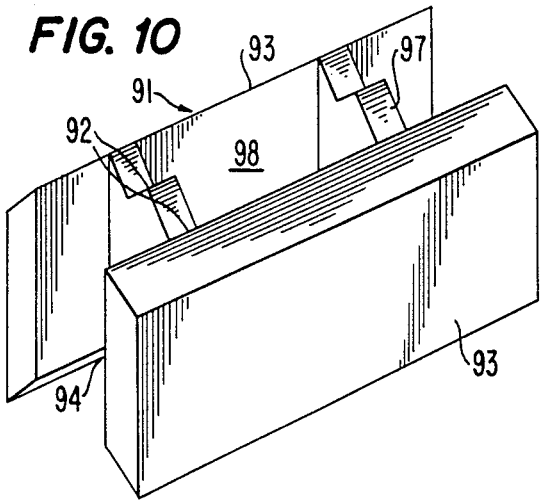
FIG. 10 is a perspective view of a building block according to the third embodiment of the invention.
Figure 12:
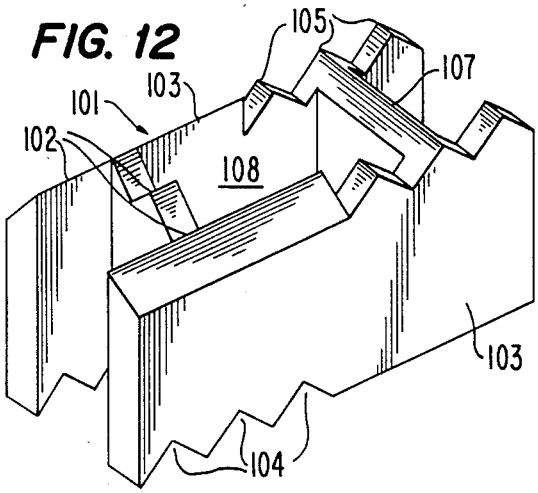
FIG. 12 is a perspective view a building block according to the fourth embodiment of the invention.

The blocks can also be made hollow, as shown in FIGS. 10 and 12. In the third embodiment of FIG. 10, a block 91 has two side walls 93 and at least two crosspieces 97 (either two or three crosspieces are preferable) extending between the side walls. At least one hollow space 98 is thus formed between the walls. The side walls and crosspieces define top and bottom surfaces which are angled so as to form three dihedral projections 92 extending longitudinally on the upper surface, and three dihedral recessions 94 extending longitudinally on the lower surface. The side walls are preferably designed to have a thickness equal to approximately one half the width of one of the projections or recessions. Like the other embodiments, when two blocks are placed on top of each other, the projections and recessions mate to securely hold the blocks in place. Like the first embodiment, a special corner block is required when a wall is built. Similar to FIGS. 6 and 7, this hollow corner block (not shown) has an upper surface which is the same as the upper surface of the block of FIG. 10, but the lower surface has the longitudinal dihedral recessions extending along only half of the block; the other half of the block has three dihedral recessions extending transverse to the block.

Figure 11:
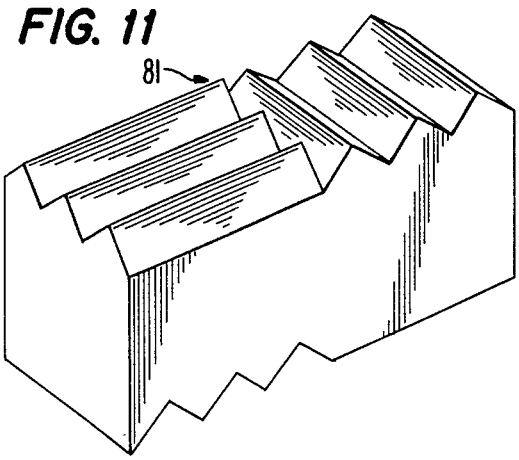
FIG. 11 is a perspective view of a solid building block from which the hollow block according to the fourth embodiment is derived.

Finally, the fourth embodiment of the invention is shown in FIG. 12, which is the block 81 of FIG. 11 made in hollow. In FIG. 12, the block 101 has side walls 103 and at least two crosspieces 107 extending between the side walls which define at least one hollow space 108 therebetween. The side walls and crosspieces define upper and lower surfaces, and the upper surface is angled so as to form three dihedral projections 102 extending longitudinally along half of the upper surface, and three dihedral projections 105 extending transverse to the block along the other half of the upper surface. The lower surface has three dihedral recessions (not shown) extending longitudinally along one half of the lower surface, and three dihedral recessions 104 extending transverse to the block along the other half of the lower surface. In all other respects, the fourth embodiment is identical to the third embodiment; it has the advantage that a special corner block is not necessary to form a wall.

Figure 14:
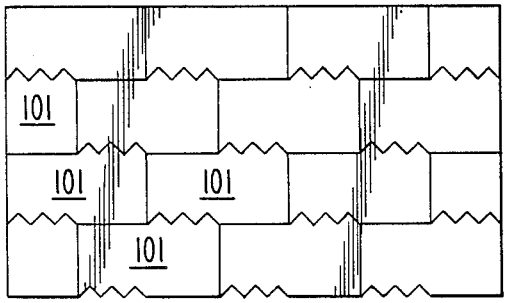
FIG. 14 is a front view showing a plurality of the building blocks of FIG. 12 placed together to form a wall.

FIGS. 13 and 14 show further examples of walls built using blocks according to the present invention. In FIG. 13, a wall using stretcher blocks 1 of the type shown in FIG. 1 and corner blocks 31 of the type shown in FIG. 6 is depicted. In FIG. 14, a wall using blocks 101 of the type shown in FIG. 12 is depicted.

Many modifications of the above described embodiments are possible without departing from the spirit and scope of the invention. For example, any number of dihedral projections and recessions can be used, the size and shape of which can be varied. The shape of the vertical channels can be varied. Therefore, the scope of the invention is measured not by the disclosed embodiments, but by the appended claims.

I claim:

1. A building block comprising a block having two opposing side surfaces, two opposing end surfaces, a top surface and a bottom surface, said top surface having a plurality of first dihedral projections each having a first load-supporting side surface and a second load-supporting side surface and extending longitudinally along the block, said bottom surface having a plurality of first dihedral recessions extending longitudinally along the block, wherein said bottom surface has at least one more of said first dihedral recessions than the top surface has of said first dihedral projections, wherein one of said first dihedral projections adjoins one of said two opposing side surfaces, and another of said first dihedral projections adjoins the other of said two opposing side surfaces.

2. The building block as claimed in claim 1 wherein said block has a vertical groove lOcated in each opposing end surface.

3. The building block as claimed in claim 1, wherein said first dihedral projections and first dihedral recessions extend along the entire length of said block.

4. The building block as claimed in claim 1, wherein the first dihedral recessions extend along one half of the length of said block, and wherein the bottom surface comprises a plurality of second dihedral recessions extending transverse to the block along the other half of the length of the block.

5. The building block as claimed in claim 4, wherein the first dihedral projections extend along the entire length of said block.

6. The building block as claimed in claim 4, wherein the first dihedral projections extend along said other half of the length of the block, and along said one half of the length of the block the top surface comprises a plurality of second dihedral projections extending transverse to the block, said top surface further comprising a planar surface extending longitudinally along the entire length of the block.

7. The building block as claimed in claim 6, wherein said bottom surface further comprises a cut-out portion located between adjacent pairs of said second dihedral recessions.

8. The building block as claimed in claim 1, wherein outer edges of said bottom surface are flattened.

9. A building block, comprising a pair of opposing side walls, and at least two crosspieces connecting said side walls, said side walls and crosspieces defining at least one open space therebetween, wherein said side walls and crosspieces define an upper surface and a lower surface, said upper surface having a plurality of first dihedral projections each having a first load-supporting side surface and a second load-supporting side surface and extending longitudinally along one ;half of the length of the block, said lower surface having a plurality of first dihedral recessions extending longitudinally along the other half of the length of the block, the number of first dihedral projections being equal to the number of first dihedral recessions, wherein one of said first dihedral projections adjoins an outer side surface of one of said two opposing side walls, and another of said first dihedral projections adjoins an outer side surface of the other of said two opposing side walls, wherein along said other half of the length of the block the upper surface comprises a plurality of second dihedral projections extending transverse to the block and along said one half of the length of the block the lower surface comprises a plurality of second dihedral recessions extending transverse to the block.

10. The building block as claimed in claim 9, wherein outer edges of said bottom surface are flattened.

11. A wall comprising a plurality of building blocks, each of said building blocks comprising a block having two opposing side surfaces, two opposing end surfaces, a top surface and a bottom surface, said top surface having a plurality of first dihedral projections each having a first load-supporting side surface and a second load-supporting side surface and extending longitudinally along the block, said bottom surface having a plurality of first dihedral recessions extending longitudinally along the block, wherein said bottom surface has at least one more of said first dihedral recessions than the top surface has of said first dihedral projections;

wherein one of said first dihedral projections adjoins one of said two opposing side surface, and another of said first dihedral projections adjoins the other of said two opposing side surfaces; and wherein at least two of said building blocks are placed on top of each other so that the first dihedral projections of one of the at least two of said building blocks mates with the first dihedral recessions of the other of the at least two of said building blocks.

12. The wall as claimed in claim 11, wherein each of said building blocks has a vertical groove located in each opposing end surface thereof, and wherein at least two of said building blocks are placed end-to-end so as to define a vertical channel therebetween.

13. The wall as claimed in claim 11, wherein at least one of said building blocks is a corner block, wherein the first dihedral recessions of said corner block extend along one half of the length of the corner block, wherein the bottom surface of the corner block comprises a plurality of second dihedral recessions extending transverse to the block along the other half of the length of the corner block and wherein the first dihedral projections of the corner block extend along the entire length of said corner block.

14. The wall as claimed in claim 11, wherein for each of said building blocks, the first dihedral recessions extend along one half of the length of said block, the bottom surface comprises a plurality of second dihedral recessions extending transverse to the block along the other half of the length of the block, the first dihedral projections extend along said other half of the length of the block, and the top surface comprises a plurality of second dihedral projections extending transverse to the block along said one half of the length of the block, said top surface further comprising a planar surface extending longitudinally along the entire length of the block.

15. The wall as claimed in claim 11, wherein outer edges of said bottom surface are flattened.

16. A wall comprising a plurality of building blocks, each of said building blocks comprising a pair of opposing side walls, and at least two crosspieces defining at least one open space therebetween, wherein said side walls and crosspieces define an upper surface and a lower surface, said upper surface having a plurality of first dihedral projections each having a first load-supporting side surface and a second load-supporting side surface and extending longitudinally along one half of the length of the block, said lower surface having a plurality of first dihedral recessions extending longitudinally along the other half of the length of the block, the number of first dihedral projections being equal to the number of first dihedral recessions;

wherein along said other half of the length of the block the upper surface comprises a plurality of second dihedral projections extending transverse to the block, and along said one half of the length of the block said lower surface comprises a plurality of second dihedral recessions extending transverse to the block;

wherein one of said first dihedral projections adjoins an outer side surface of one of said two opposing side walls, and another of said first dihedral projections adjoins an outer side surface of the other of said two opposing side walls; and wherein at least two of said building blocks are place on top of each other so that the first dihedral projections of one of the at least two of said building blocks mates with the first dihedral recessions of the other of the at least two of said building blocks.

17. The wall as claimed in claim 16, wherein outer edges of said bottom surface are flattened.

* * * * *